US007802581B2

(12) United States Patent
Heim

(10) Patent No.: US 7,802,581 B2
(45) Date of Patent: Sep. 28, 2010

(54) BUFFER FOR TREKKING OR NORDIC-WALKING POLES

(75) Inventor: Eberhard Heim, Unterensingen (DE)

(73) Assignee: Lekisport AG, Baar (CH)

( * ) Notice: Subject to any disclaimer, the term of this patent is extended or adjusted under 35 U.S.C. 154(b) by 8 days.

(21) Appl. No.: 11/915,707

(22) PCT Filed: May 22, 2006

(86) PCT No.: PCT/CH2006/000268

§ 371 (c)(1),
(2), (4) Date: Nov. 27, 2007

(87) PCT Pub. No.: WO2006/128312

PCT Pub. Date: Dec. 7, 2006

(65) Prior Publication Data

US 2008/0196753 A1 Aug. 21, 2008

(30) Foreign Application Priority Data

Jun. 3, 2005 (CH) ..... 0942/05

(51) Int. Cl.
*A45B 9/04* (2006.01)

(52) U.S. Cl. ..... 135/86; 135/77

(58) Field of Classification Search ..... 135/82, 135/84, 85, 86, 77
See application file for complete search history.

(56) References Cited

U.S. PATENT DOCUMENTS 3,177,884 A 4/1965 Thro
4,493,334 A * 1/1985 Semanchik et al. ..... 135/75
4,899,771 A * 2/1990 Wilkinson ..... 135/77
5,032,135 A * 7/1991 Jacobson ..... 623/27
5,088,513 A 2/1992 Ostermeyer
5,301,704 A * 4/1994 Brown ..... 135/78

(Continued)

FOREIGN PATENT DOCUMENTS

DE 20 58 863 A1 5/1972

(Continued)

*Primary Examiner*—David Dunn
*Assistant Examiner*—Noah Chandler Hawk
(74) *Attorney, Agent, or Firm*—Sughrue Mion, PLLC

(57) ABSTRACT

The invention describes a buffer (2) for a stick (1), in particular for a walking stick or a trekking or Nordic-Walking pole. The buffer (2) has means (10) for being attached to a stick tube (Ia), in particular in the form of a recess, at its upper end (4) and a rolling surface (5) at its lower end. In this case, the rolling surface (5) is of substantially flat or only slightly convex design in a transverse direction (22) in relation to the rolling motion but in a longitudinal direction (21) which is perpendicular thereto is convexly curved in such a way that it forms a rolling surface on a base surface (3) during the pushing-off movement with the stick when the user of the stick (1) moves. In the case of a buffer (2) of this type, an excellent degree of suitability and adhesive action for a very wide variety of base surfaces and at the same time quiet and problem-free use on hard base surfaces can be achieved by the buffer (2) being formed from an elastomeric material at least in the region of the rolling surface (5), and by at least one elastically mounted, hard, inelastic retaining element (9) being arranged in the elastomeric material.

21 Claims, 6 Drawing Sheets

U.S. PATENT DOCUMENTS

| | | | | | |
|---|---|---|---|---|---|
| 5,331,989 | A | * | 7/1994 | Stephens | 135/65 |
| 5,409,029 | A | * | 4/1995 | Davis | 135/68 |
| 5,778,605 | A | * | 7/1998 | Ellena et al. | 135/78 |
| 5,826,606 | A | * | 10/1998 | Davenport | 135/82 |
| 5,829,463 | A | * | 11/1998 | Galan | 135/77 |
| 5,954,075 | A | * | 9/1999 | Gilmour | 135/84 |
| 7,360,547 | B2 | * | 4/2008 | Carlson | 135/66 |
| 2004/0226593 | A1 | * | 11/2004 | Robitaille et al. | 135/77 |

FOREIGN PATENT DOCUMENTS

| | | | |
|---|---|---|---|
| DE | 203 18 553 | U1 | 4/2004 |
| DE | 203 18 682 | U1 | 4/2005 |
| EP | 0 518 539 | A | 12/1992 |
| EP | 0 978 298 | A1 | 2/2000 |
| FR | 1 246 463 | A | 11/1960 |

* cited by examiner

BUFFER FOR TREKKING OR NORDIC-WALKING POLES

TECHNICAL FIELD

The present invention relates to a buffer for a pole, in particular for a trekking pole, walking stick or Nordic walking pole, it being the case that the buffer, at its top end, has means for fastening on a pole shaft, in particular in the form of a recess, and, at its bottom end, has a rolling surface, and that the rolling surface is of essentially planar or only slightly convexly curved design in a transverse direction, as seen in relation to the rolling movement, but in a longitudinal direction, perpendicularly thereto, is curved convexly such that, as the user of the pole is moving, it forms a rolling surface as the pole is pushed off an underlying surface. The present invention also relates to a trekking pole, walking stick or Nordic walking pole having such a buffer, and to methods of producing such buffers or damping elements.

PRIOR ART

For health reasons, trekking, and equally mountaineering, is increasingly being done with the aid of at least one pole, and preferably even two poles. In particular so-called Nordic walking is even based on the use of two poles, which therefore allows dynamic movement which does not adversely affect the joints.

Both techniques are used on a wide variety of different terrains, in particular, on the one hand, on hard, sealed surfaces, for example tarred roadway and paths, but also, on the other hand, for example on soft surfaces such as country paths and fields or also on snow-covered or ice-covered surfaces.

For soft surfaces or for snow-covered or ice-covered surfaces, use can usually be made of the classic tip, as is known, for example from downhill skiing or cross-country skiing. Such a hard tip, however, is not suitable for hard, sealed surfaces since, on the one hand, the resulting impacts are harmful to the joints and, on the other hand, the level of adherence or friction for pushing the pole off the ground is too low and the level of sound/noise developed upon impact is too high. Correspondingly, buffers which are made of elastomeric material and can be pushed, for example, onto a conventional pole have already been proposed for such surfaces.

In order for it not to be necessary for the tip to be modified every time as the underlying surface changes, combined forms have already been proposed, these having, for example, a kind of classic tip passing through such a rubber buffer and thus, in respect of the pole being pushed off the ground, partially combining the advantages of both systems. Such a system is described, for example, in EP-A-0 978 298.

However, such a system still has the disadvantage, on the one hand, that the projecting tip still strikes harshly against hard surfaces and is thus problematic for the joints and, on the other hand, that an unpleasant level of sound/noise develops when the hard tip strikes against the underlying surface. In addition, at the moment when such a tip strikes as it rolls onto the underlying surface, the resistance or the friction is usually insufficient for pushing the pole off the ground.

Correspondingly, systems in which the tip, depending on requirements, can be recessed in the buffer or pushed out through the same have already been proposed. However, such systems are mechanically complex and correspondingly expensive; in addition, as a result of the moving parts, they usually attract dirt and, in particular, they also require manipulation by the user as the terrain changes, which is normally undesirable.

DESCRIPTION OF THE INVENTION

This is where the invention comes in. Accordingly, one object of the invention is to provide an improved buffer which can be used for a trekking pole, walking stick or Nordic walking pole and is suitable for a wide variety of different terrains. The task in particular is to provide a buffer for a pole, in particular for a trekking pole, walking stick or Nordic walking pole, it being the case that the buffer, at its top end, has a fastening element for fastening on a pole shaft, e.g. in the form of a recess, and, at its bottom end, has a rolling surface, and that preferably the rolling surface is of essentially planar or only slightly convexly curved design (if appropriate with hollow-like indents or depressions) in a transverse direction, as seen in relation to the rolling movement, but in a longitudinal direction, perpendicularly thereto, is curved convexly such that, as the user of the pole is moving, it forms a rolling surface as the pole is pushed off an underlying surface.

This object is preferably achieved in that the buffer consists of an elastomeric material, at least in the region of the rolling surface, and in that at least one elastically mounted, hard, essentially non-elastic retaining element is arranged in the elastomeric material.

One finding of the invention is thus, to a certain extent, for the function of a tip to be performed by at least one retaining element which is mounted elastically in the elastomeric material. This means that the hard, non-elastic retaining element, for example made of metal and/or ceramic material, can engage in soft terrains and thus, in a manner similar to a classic pole tip, and is suitable for such soft terrains. However, the fact that the retaining element is mounted elastically in the elastomeric material results in a surprising effect when the pole is used on a hard underlying surface, namely that, by virtue of being embedded elastically, the retaining element does not transmit any hard impacts to the pole handle, and thus does not have any adverse effects on the locomotor apparatus, and that, furthermore, embedding the retaining element elastically means that there is essentially no unpleasant impact noise, which is unavoidable with conventional tips. The effect is therefore similar to that of a spike as is known from use in winter tires.

The retaining element here has a hardness which preferably, on Mohs' scale, is greater than 3, in particular preferably greater than 4 or 5, or even greater than 6 or 7. The hardness specified relates here to that region of the retaining element which comes into contact with the terrain or penetrates into the same. Those regions of the retaining element which do not come into contact with, or penetrate into, the terrain may readily have a lower level of hardness, and they can even consist of soft and partially elastic material, as long as it is ensured that they are secured to a sufficient extent in the material of the buffer.

According to a first embodiment, the at least one elastically mounted retaining element projects, at least in part, beyond the rolling surface, typically by in the region of half a millimeter to 2 or 3 mm or more. The depth to which the retaining element is anchored in the buffer here is typically greater than the height which projects beyond the rolling surface.

The rolling surface is preferably generally of asymmetrical design in that it is drawn upward at the front end (that is to say in the walking direction) and the rear end essentially forms a point. This results in ideal rolling behavior of the, for example, usually rather long poles used for Nordic walking.

According to a further embodiment, at least 2, preferably at least 4, at least 6 or at least 8 retaining elements are arranged on or in the rolling surface. The retaining elements are preferably spaced apart in the longitudinal direction, that is to say in the walking direction, it being possible for at least 2 or at least 3 or at least 4 retaining elements to be arranged in at least one row or to be offset in particular laterally in relation to one another in the longitudinal direction. This particular arrangement of the retaining elements proves to be extremely suitable in particular in conjunction with the specifically configured rolling surface, which is convex in the walking direction. This is because it is thus ensured that, throughout the movement sequence, there is always a retaining element in contact with the terrain.

A further embodiment is distinguished in that at least 4, preferably 6 or 8 retaining elements are provided, and in that the retaining elements are arranged in at least 2 transversely offset rows of correspondingly 2, 3 or 4 retaining elements. The fact that various rows are offset laterally gives the additional advantage that, if the pole is set down at an angle or if the terrain is uneven, there are always retaining elements in contact with the terrain.

Particularly good suitability for a wide variety of different underlying surfaces can be achieved if, according to a further embodiment, the rolling surface, in addition, has a profile. In this case, preferably the at least one retaining element is arranged on at least one top cleat surface of the profile. The profile may have at least one, preferably central longitudinal channel and at least 2, 3 or 4 transverse channels branching off symmetrically, in particular laterally, therefrom, and two rows of, for example, in each case four retaining elements running in the longitudinal direction may be arranged on the top cleat surfaces of the rolling surface, these cleat surfaces being formed by the channels.

The buffer preferably consists entirely of a single piece of elastomeric material, in particular preferably of a possibly vulcanized natural and/or synthetic rubber, in particular preferably with a hardness of 20 to 80 Shore A, preferably of 50-70 Shore A, e.g. 55-64 Shore A. Use may be made, for example, of typical tire materials.

According to another embodiment, the retaining element is designed in the form of a pin which has its first end embedded in the elastomeric material and has its second end projecting beyond the top of the rolling surface. Preferably the region which projects at the second end is delimited from, and/or supported in relation to, the rolling surface by an in particular preferably encircling flange or collar. The second end typically projects beyond the top of the rolling surface by way of a height in the region of 0.05-5 mm, in particular preferably in the region of 1-2 mm. The collar preferably has a circular-ring width of 0.5-1.5 mm.

The retaining element preferably has a particularly hard, in particular hardened, tip at its second end.

The retaining element may have a single-piece anchoring element which, apart from a flange or collar (the flange or collar may be formed integrally with the anchoring element or as an individual element), is embedded in the elastomeric material, it being the case that, on its side which is directed toward the rolling surface, the anchoring element preferably has a recess in which a tip element, for example in the form of a metal pin, is incorporated and fastened. The anchoring element may consist, for example, of plastic, iron, steel, in particular stainless steel, brass, aluminum or other nonferrous metals. The tip element may consist, for example, of ceramic material, hardened metal, in particular hardened steel, sintered hard metals or other wear-resistant materials. The tip element may also be coated, using appropriate methods, with a wear-minimizing surface (e.g. TiN, TiCN, etc.).

According to a further embodiment, in the region which is embedded in the elastomeric material, the anchoring element preferably has anchoring elements, in particular preferably in the form of anchoring lamellae. Preferably a plurality of encircling anchoring lamellae are provided, and these are of conical design in the direction away from the rolling surface and of stepped design in the direction toward the rolling surface. In the case of such a specific design, the anchoring element, or the retaining element as a whole, can be particularly straightforwardly introduced, or driven, into the buffer by the method described hereinbelow.

A particularly straightforward design is possible if a single, elastically mounted, hard, non-elastic retaining element is arranged in the elastomeric material, this retaining element preferably projecting, at least in part, downward beyond the rolling surface. The retaining element here has an anchoring element which, preferably apart from a flange, is embedded in the elastomeric material, it being the case that, in the region which is embedded in the elastomeric material, the retaining element has anchoring means, in particular preferably in the form of anchoring lamellae. On its side which is directed toward the rolling surface, the anchoring element may have a recess in which a tip element is incorporated and fastened, as has been explained above. Such a single retaining element is arranged centrally in particular preferably in the transverse direction.

The buffer may additionally be provided with a specific flexibility, in particular when, as has been explained above, it consists entirely of a single piece of elastomeric material. This specific flexibility is possible by recesses being provided in the regions which may be of a softer structure. A particularly preferred region of this type is the front edge of the buffer. It is also advantageous, according to a further preferred embodiment of the invention, if, on its front edge, the buffer has a crosspiece formed by two laterally provided recesses, this crosspiece extending preferably over at least 10%, in particular preferably over in the region of 20-40%, of the overall length of the front edge. Analogous measures may be taken in respect of the rear edge.

In order to increase the grip of the buffer, in particular in soft material into which the buffer penetrates to a considerable extent, it is additionally possible to provide a profile laterally as well, rather than just in the downward direction on the rolling surface. According to a further preferred embodiment, it is thus possible to design the buffer with an asymmetric rolling surface in that it is drawn upward at the front end and the rear end essentially forms a point, and additionally to provide lateral protrusions which project laterally beyond the outer contour of the buffer and, correspondingly, allow better engagement in the material of the ground. In this case, preferably at least two, in particular preferably at least three, such lateral protrusions are provided on each side of the buffer.

The present invention also relates to a trekking or Nordic walking pole having a buffer as has been described above.

The present invention additionally relates to a method of producing a buffer as has been described above. The method is characterized, in particular, in that the at least one retaining element is driven into the rolling surface, essentially perpendicular to the rolling surface, at the appropriate locations, for example onto the cleats of a profile, appropriate blind holes possibly having been formed beforehand by drilling, melting or burning or even having been molded in during the process for producing the preform.

An alternative to this method consists in that the at least one retaining element is pushed into the rolling surface, essentially perpendicularly to the rolling surface, at the appropriate locations, in the process being pushed into, and adhesively bonded in, blind holes which are correspondingly formed by drilling or even during the process for producing the preform.

Further embodiments of the invention are described in the dependent claims.

BRIEF DESCRIPTION OF THE FIGURES

The invention will be explained in more detail hereinbelow, with reference to exemplary embodiments, in conjunction with the drawings, in which.

WAYS OF IMPLEMENTING THE INVENTION

The figures, which should be used as an illustration of the invention and not for limiting the scope of protection as formulated in the patent claims, will now be used hereinbelow to describe exemplary embodiments.

Figure 1:
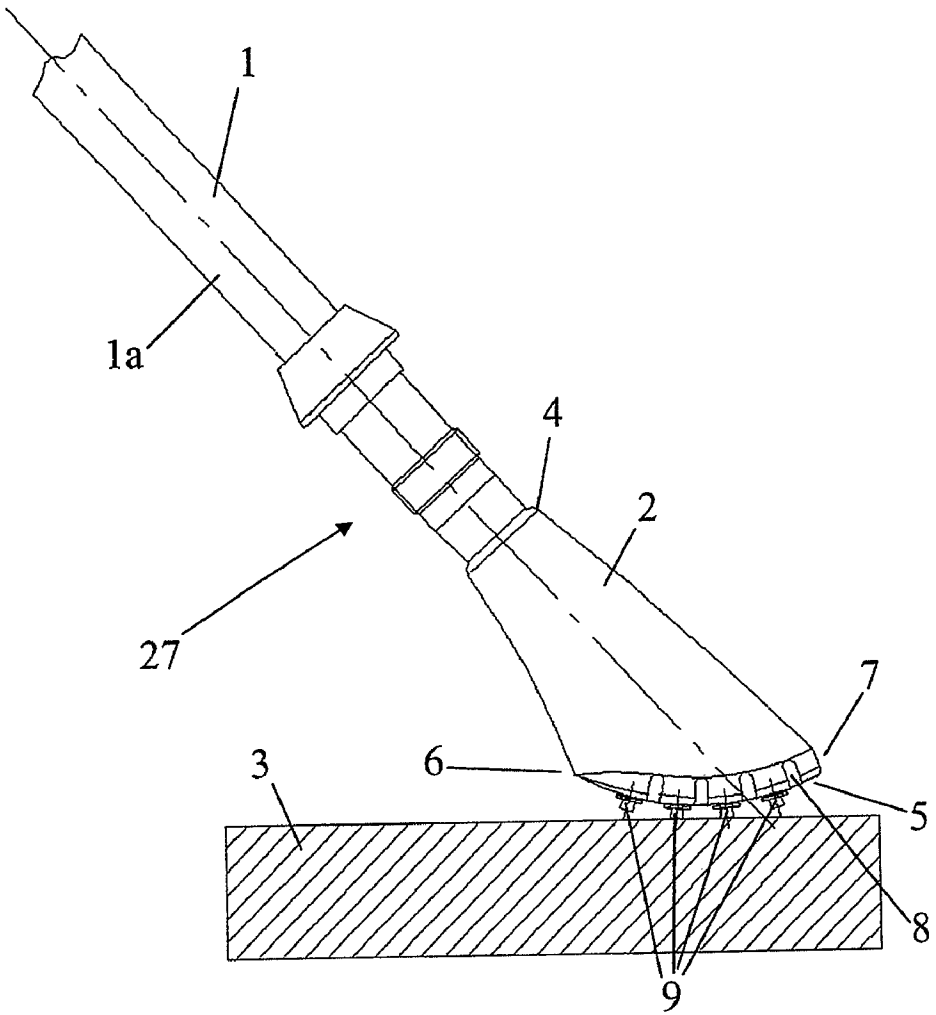
FIG. 1 shows a lateral view of a pole with a buffer according to the invention.

FIG. 1 shows a Nordic walking or trekking pole 1 in the bottom region, that is to say the region which is usually directed toward the ground 3 during usage. On the top side (not illustrated), such a pole usually has a handle with a hand strap by which the pole is gripped. The pole has a pole shaft 1*a*, which may be, for example, an aluminum shaft and/or a fiber-reinforced plastic shaft.

In the region of the bottom end, a buffer 2 is fastened on this pole shaft 1*a*. For this purpose, the buffer 2 is provided, at its top end 4, with a blind hole or a recess 10 (see FIG. 2), into which the pole shaft 1*a* is pushed, and in which it is possibly even adhesively bonded in addition. The pole shaft 1*a* here may have a shaft end which either has not undergone any further processing or is provided with additional elements (in this case, for example a plastic sleeve may be provided in the recess, this sleeve being fastened on the pole and/or on the buffer integrally or via a force fit); however, it is also possible for the bottom of the shaft tube 1*a* to be provided with a tip, as is known for example from skiing or trekking, that is to say, in this case, the buffer 2 is pushed onto such a tip.

The buffer 2 has a rolling surface 5 at its bottom end. This rolling surface 5 has a front end 6 and a rear end 7, front and rear relating to the walking direction.

In other words, the illustration in FIG. 1 should be understood such that, as seen in the plane of the paper, a walker is walking from right to left and correspondingly, when the pole is set down essentially vertically, first of all the rolling surface is set down at the rear end 7 and, as the walker progresses, as a result of the increasingly left-hand leaning of the pole, the latter rolls on the rolling surface 5 until at the end, just before the pole is raised up, the rolling surface only rests on the ground 3 in the region of the front end 6.

The shape is optimized for movement insofar as a certain triangular structure, as seen from the side, is predetermined, of which the long leg, which is directed toward the rear, is formed essentially along the axis of the pole, the bottom point of this long leg being formed by the rear end 7, and of which the bottom, short leg is formed convexly, in the direction of the ground, as the rolling surface, in which case the point which is directed toward the front is formed by the front end 6 of the rolling surface 5.

Incorporated on the rolling surface 5, or in this rolling surface 5, are retaining elements 9 which project some way beyond the rolling surface in the direction of the ground. As can be seen from FIG. 2, these retaining elements are of pin-like design and a considerable part of each pin is incorporated in the material of the buffer 2.

The buffer 2 is produced from an elastomeric plastic material, for example from materials which are conventional in tire production, that is to say examples of suitable materials are vulcanized synthetic rubbers. Such a buffer 2 may be produced by molding.

It is also possible to produce the buffer from different materials, for example for it to be produced, in the region which is directed toward the top end, from a first, possibly even non-elastic, plastic material and, in the region of the rolling surface, for example with a height from 2 to 10 mm, from an elastomeric plastic material. Such a buffer may be produced either by coextrusion, or two-component injection molding, or, for example, by virtue of the different materials being adhesively bonded. The essential factor is for the buffer always to consist of an elastomeric material in the region of the rolling surface since, otherwise, it is not possible for the retaining elements 9 to be mounted elastomerically according to the invention.

Figure 2:
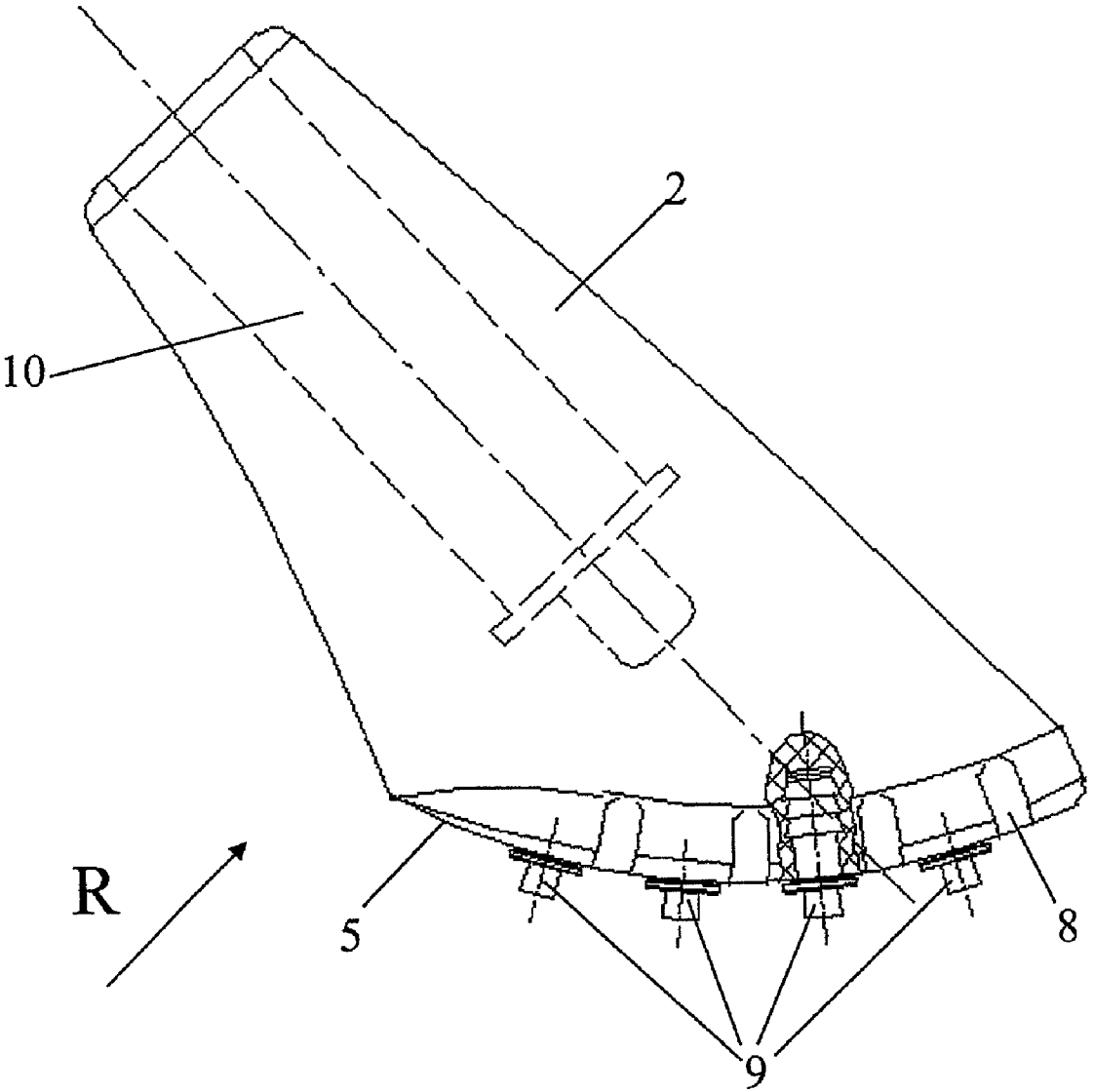
FIG. 2 shows a lateral view, in detail form, of a buffer without a pole shaft.
Figure 3:
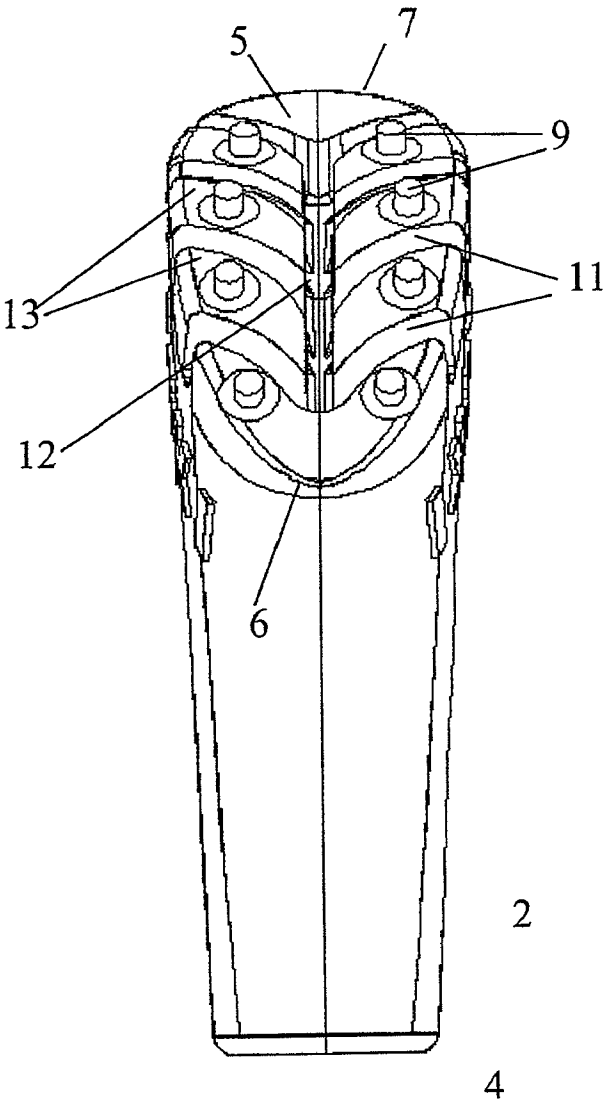
FIG. 3 shows a plan view of the rolling surface as seen in direction R in FIG. 2.

In addition, the buffer 2 preferably has a profile 8 on the rolling surface 5. This is easiest to see from FIG. 3, which represents a view as seen in direction R, as is illustrated in FIG. 2. In the case of the profile 8, different channels 11, 12 are provided in the elastomeric material. The cleats of the profile form between these channels, with a depth, for example, in the region of 1-4 mm. The cleats each have a top surface 13, which is planar at least in certain sections and/or is of convex design in the longitudinal direction 21. The retaining elements 9 are incorporated in these top surfaces 13, or in the cleats located therebeneath.

In conjunction with the typical movement sequence, it proves to be advantageous to provide a profile with a central longitudinal channel 12, from which transverse channels 11 branch off laterally. This results in the formation of two rows of cleats which run parallel in the longitudinal direction and on the top surfaces of which the retaining elements 9 may be arranged in likewise two rows. In order to prevent wear in the peripheral region at the front end 6 and/or the rear end 7, this region being subjected to particular loading, and or to prevent cleats from dropping out, it proves to be advantageous to allow the longitudinal channel 12 to run just over the central section, in which case the final cleats, as it were, are connected to one another at the ends 6, 7.

Figure 4:
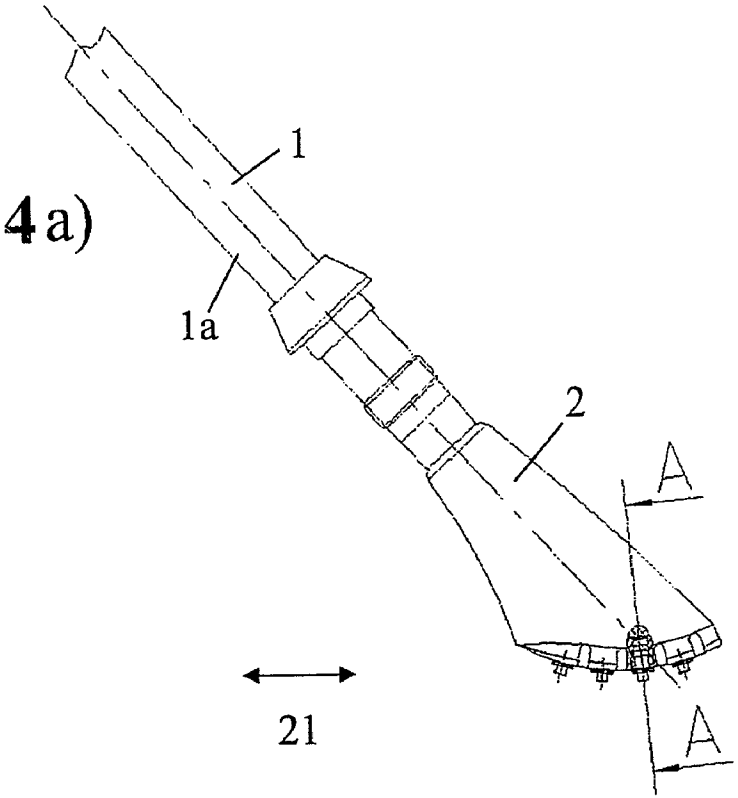
FIG. 4*a*) shows a lateral view according to FIG. 1, and b) shows a section along line A-A in FIG. 4*a*)
Figure 4:
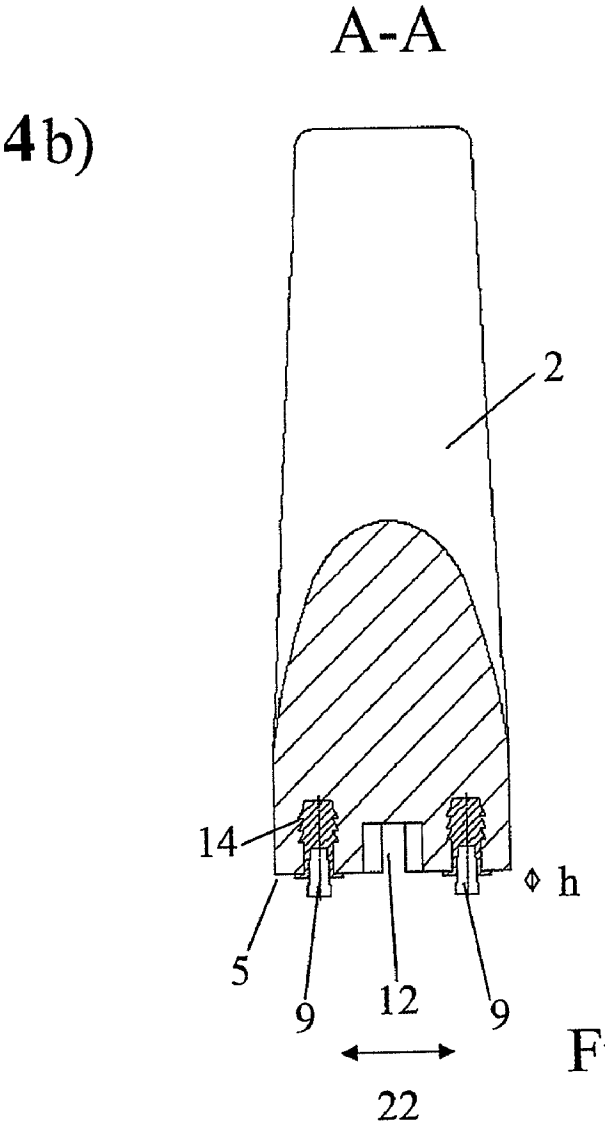

The operation of embedding or fastening the retaining elements 9 in the buffer 2 will be explained in detail with the aid of FIG. 4. FIG. 4*a* shows a view analogous to the view of FIG. 1, although the longitudinal direction 21 and the section plane A-A, which is illustrated in FIG. 4*b*) are indicated in addition. It can be seen here how the retaining elements 9 are incorporated in recesses or bores or holes 14 in the cleats. They project beyond the top of the rolling surface by way of a height h, which is typically in the region of 0.5-3 mm.

Figure 5:
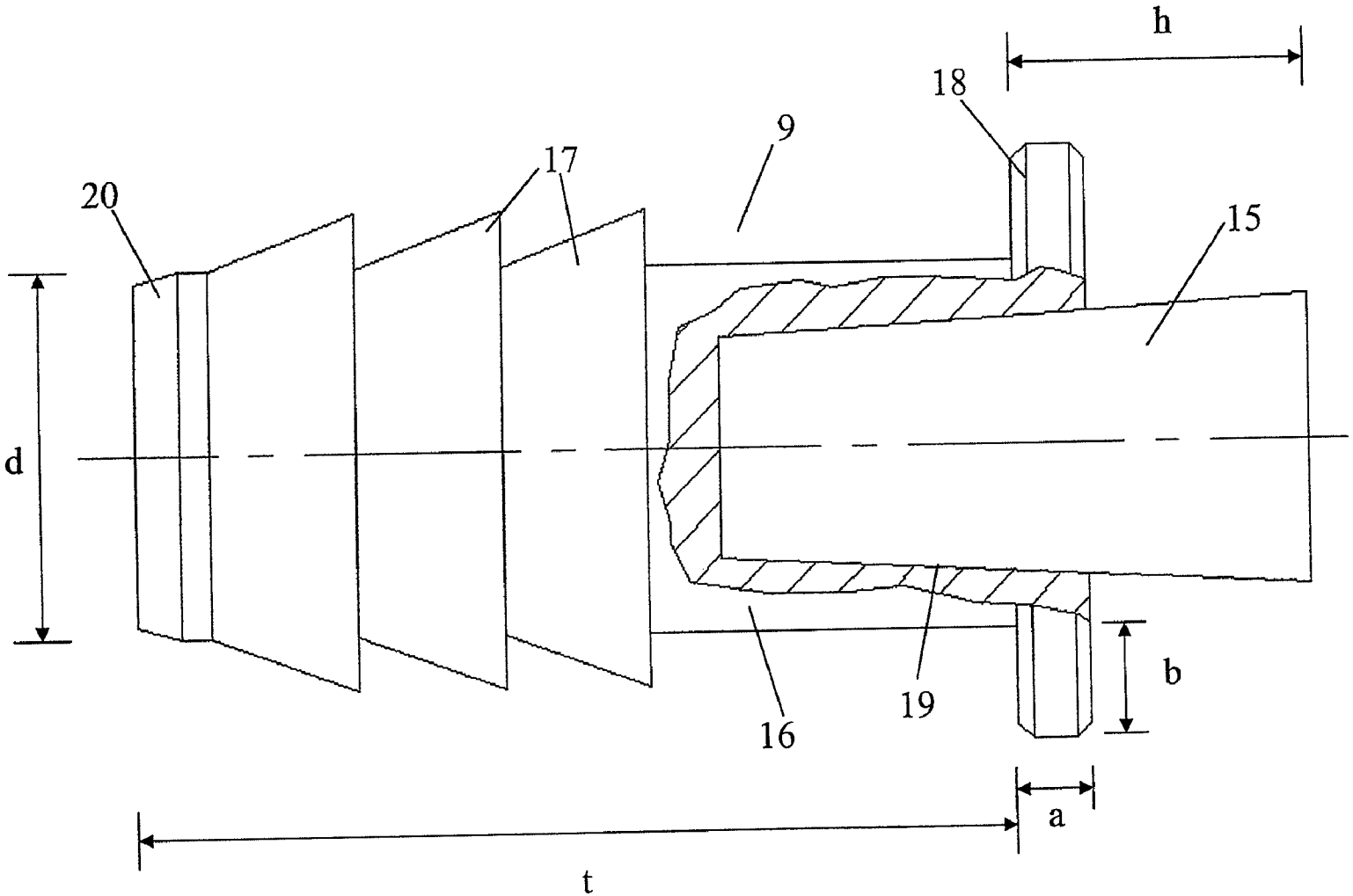
FIG. 5 shows a lateral view of a retaining element, partly in section.

A possible retaining element 9 is illustrated in detail in FIG. 5. The retaining element 9 may be formed in a single piece, but in this case it comprises two elements, namely an anchoring element 16 and a tip element 15.

The anchoring element 16 serves essentially to fasten the tip element 15 in the elastomeric material of the buffer 2. It is of cylindrical design for this purpose and, on its side which is directed toward the buffer, it has a slightly conically tapering tip 20, which makes it easier for such an element 9 to be introduced or driven in.

Also provided are anchoring lamellae 17, which are intended to prevent the retaining element 9 from being "worked out" of the buffer under mechanical loading. In this respect, anchoring in elastomeric material is known to be problematic, and it has been found that barb-like lamellae 17 are particularly suitable for lasting fastening in such an environment.

At its end which is directed toward the rolling surface 5, the anchoring element 16 has a recess 19 in the form of a, for example, conically tapering blind hole, into which the tip element 15 can be introduced and fastened. Fastening here can take place via force fitting, form fitting (e.g. screw connection), pressing or adhesive bonding or the like.

In addition, the anchoring element 16 has a collar or flange 18 at its outermost end. This collar serves for preventing the retaining element 9 from sinking all the way into the elastomeric material under loading. The anchoring element 16 has a diameter d in the region of 1-3 mm. The collar has a thickness a in the region of 0.2-1.5 millimeters and an annular-ring width b in the region of 0.5-2 mm. Furthermore, the anchoring element 16 has an anchoring depth t in the region of 1-15 mm or above, preferably of 2-7 mm or 5-10 mm.

The anchoring element may be produced from metal, for example steel, iron, stainless steel, brass, aluminum or other nonferrous metals, in which case it may be produced by casting or machining. It is likewise possible to use plastic materials (more lightweight), for example polyethylene, polycarbonate, polypropylene, PVC, polyamide, etc., it also being possible for such materials to be fiber-reinforced. Anchoring elements made of such plastic materials may be produced, for example, by injection molding.

The tip element 15 may be formed integrally with the anchoring element 16, in which case it is then recommended to subject the tip element 15 to a special hardening process or coating process.

However, as is illustrated in FIG. 5, the tip element 15 may preferably be designed as a separate element which is installed in the anchoring element 16 or connected thereto in some other way.

The tip element may be, for example, a pin made of a preferably hardened material, e.g. of metal such as hardened steel, sintered hard metals or other wear-resistant materials. The tip element may also be coated, using appropriate methods, with a wear-minimizing surface (e.g. TiN, TiCN, etc.). It is also possible, however, to provide tips made of ceramic material. Such a tip element 15 normally has a diameter D in the region of 1-2.5 mm.

Figure 6:
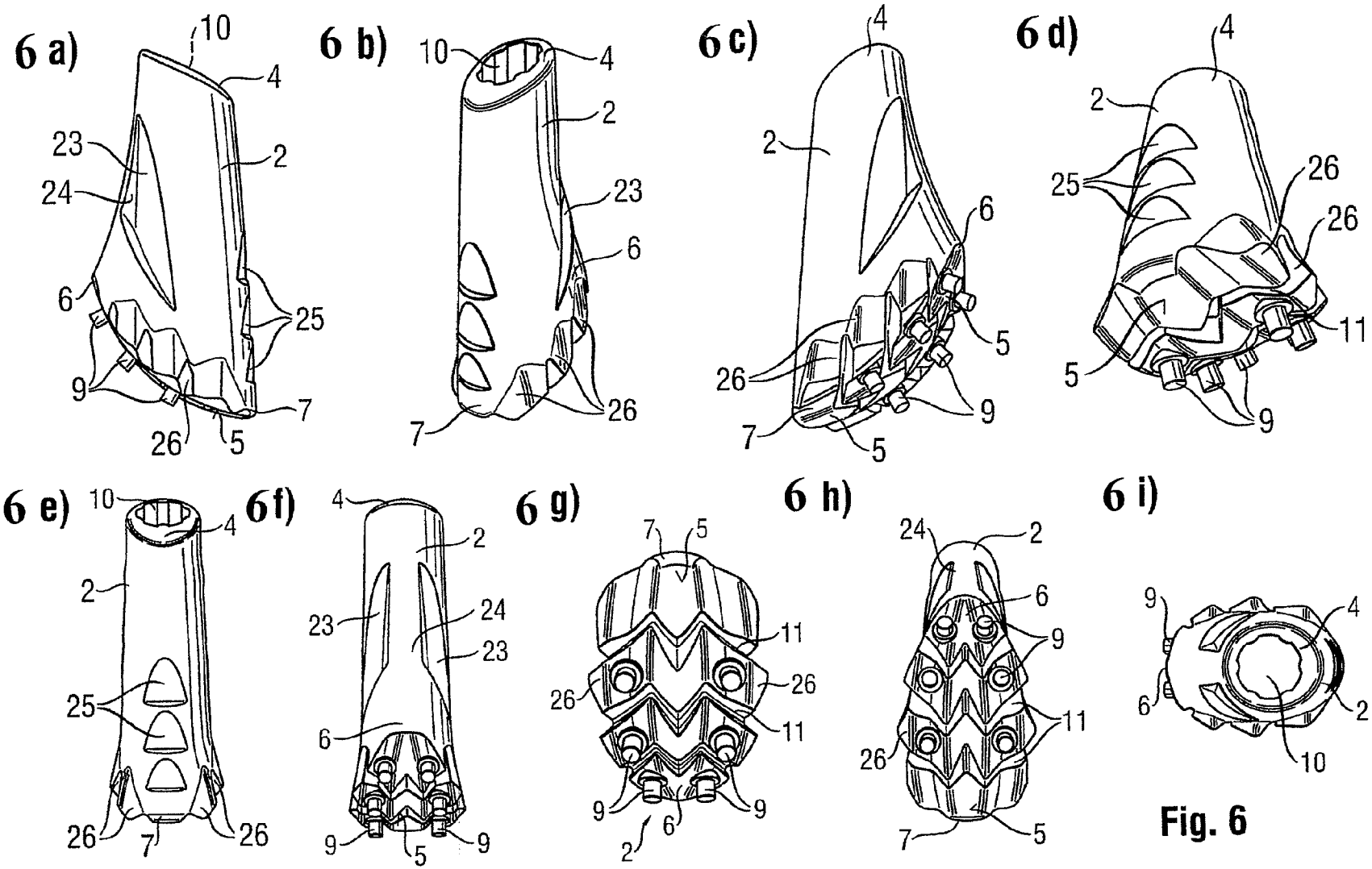
FIG. 6 shows different views of a further buffer according to the invention, a) showing a lateral view, b) showing a perspective view from above of the rear top side, c) showing a perspective view from beneath of the rolling surface, d) showing a perspective view from beneath of the rear underside, e) showing a view from behind, f) showing a view from the front, g) showing a view from beneath of the rolling surface along the pole axis, h) showing a view from beneath of the rolling surface as seen obliquely from the front, and i) showing a view from above.

A further exemplary embodiment of a buffer 2 is illustrated in FIG. 6. The buffer has retaining elements 9, as described above, and it is produced entirely from a single piece of elastomeric material. At its top end 4, it has a recess 10, into which the pole shaft (not illustrated) can be pushed. On the underside, the buffer 2 has an asymmetric rolling surface 5, and six retaining elements 9 are arranged, essentially in two rows, in the elastic rolling surface 5. In accordance with the slightly lenticular shape of the rolling surface, as can be seen in particular in FIG. 6*h*), these two rows, rather than being parallel, are arranged to follow this lens shape such that the retaining elements 9 arranged at the front end 6 are close together and the spacing between the retaining elements becomes gradually greater in the direction of the rear end 7. In this case, the rolling surface 5 likewise has a profile, but the profile only has transverse channels 11 provided in zigzag form.

The buffer according to FIG. 6 is, in particular, additionally characterized in that in the region of the rolling surface 5, in addition to having a profile in the direction of the underside, it additionally has a lateral profile, provided in the form of lateral protrusions 26. These lateral protrusions 26, which may also be formed by corresponding incisions in the outer contour (which are then, in particular preferably, oriented in the same direction as the transverse channels 11), result in the buffer, for example when it penetrates into soft ground material, being anchored to better effect in this ground material in the walking direction. These lateral protrusions 26 are preferably arranged symmetrically on both sides and, as in the present case, 2 or 3 such protrusions are provided on each side.

A further special feature of the embodiment according to FIG. 6 is that in the region of the front edge, that is to say above the front end 6, tapered portions or elongate recesses 23 are provided on both sides. A kind of crosspiece 24 or a web remains between these recesses 23. This configuration of the buffer means that, when it rests on the ground at the front end of the rolling surface (that is to say at the end of the rolling movement), the buffer is softer since, in the region of the front edge, it is essentially only the narrow elastic crosspiece 24 which is capable of absorbing the forces. This softer configuration in the front region means that, when the pole is pushed off the ground, a more elastic, and thus more pleasant, behavior is achieved, and that the level of noise produced when retaining elements 9 strike against hard ground is not as high. Similar tapered portions to achieve specific flexibility of the buffer are also possible, and may be expedient, in other regions. The crosspiece 24 may also be configured in an exchangeable manner. It is thus possible to use, depending on requirements, for example different crosspieces with different damping behaviors (for example indicated on the different crosspieces by different colors; different damping behaviors can be set, for example, by different materials being selected).

In addition, it is also possible, although this is not illustrated in the figures, to provide just a single retaining element 9, as described in detail above, that is to say with one flange and one tip element 15 incorporated, in the rolling surface of such an asymmetric buffer, in particular along the central axis of the buffer, as seen in the walking direction. Such a design is particularly straightforward and, nevertheless, has the advantages according to the invention. Such a retaining element 9 can also be driven retrospectively into an existing buffer.

It can also be seen from FIGS. 6*e*) and *i*) that it is possible for the inside of the recess 10 to be specially configured in order to ensure that a buffer can also be removed from a pole tip again without any unreasonable level of effort being required. This is because, in particular in the case of an entirely elastomeric buffer, it is normally the case that the latter adheres to the pole in the manner of a suction cup such that it is very difficult to remove. This can be prevented, for example, in that, as is illustrated in FIG. 6, the cylindrical inner surface is provided with channels or grooves running in the longitudinal direction of the pole or of the recess. These channels or grooves preferably run over the entire depth of the recess, but they may also be formed just in certain sections. It is likewise possible for a similar effect to be ensured by protuberances or similar protrusions.

LIST OF DESIGNATIONS

1 Pole
1*a* Pole shaft
2 Buffer/damping element
3 Ground
4 Top end of 2
5 Rolling surface of 2
6 Front end of 5
7 Rear end of 5
8 Profile of 5
9 Retaining element
10 Recess in 2
11 Transverse channels in 2
12 Longitudinal channel in 2
13 Top cleat surface
14 Recess for 9
15 Tip element of 9
16 Anchoring element of 9
17 Anchoring lamellae
18 Flange
19 Recess for 15 of 9
20 Conical tip of 9
21 Longitudinal direction
22 Transverse direction
23 Lateral recesses
24 Crosspiece
25 Front recesses
26 Lateral protrusions
27 Tip of 1

The invention claimed is:

1. A buffer for a pole, wherein the buffer, at a top end, has a fastening element for fastening on a pole shaft in the form of a recess, and, at a bottom end, has a rolling surface, and wherein the rolling surface is of essentially planar or only slightly convexly curved design in a transverse direction, as seen in relation to the rolling movement, but in a longitudinal direction, perpendicularly thereto, is curved convexly such that, as a user of the pole is moving, it forms a rolling surface as the pole is pushed off an underlying surface, wherein the rolling surface has a profile with cleats formed by channels, wherein the buffer consists of a single piece of elastomeric material with a hardness of 50-70 Shore A, and wherein at least two elastically mounted, hard, non-elastic retaining elements are arranged in the elastomeric material and on at least two top cleat surfaces of the profile wherein the retaining element comprises an anchoring element which is embedded in the elastomeric material, wherein, on a side which is directed toward the rolling surface, the anchoring element has a flange which is not embedded in the elastomeric material and surrounds a recess in which a tip element is incorporated and fastened, wherein the tip element projects beyond the rolling surface by 0.5-3 mm, wherein the anchoring element is embedded in the elastomeric material with an anchoring depth of 5-10 mm, and wherein the anchoring depth in the elastomeric material is larger than the depth of the channels wherein, in the region of the anchoring element which is embedded in the elastomeric material, the anchoring element has a plurality of encircling anchoring lamellae, and the encircling anchoring lamellae are of conical design in the direction away from the rolling surface and of stepped design in the direction toward the rolling surface.

2. The buffer as claimed in claim 1, wherein each of the at least two elastically mounted retaining element projects, at least in part, beyond the rolling surface, and wherein the rolling surface is of asymmetrical design in that it is drawn upward at the front end and the rear end essentially forms a point.

3. The buffer as claimed in claim 2, wherein at least four retaining elements are provided.

4. The buffer as claimed in claim 1, wherein the retaining elements are spaced apart in the longitudinal direction, at least two of said retaining elements being arranged in a row in the longitudinal direction.

5. The buffer as claimed in claim 4, wherein at least four retaining elements are provided, and wherein the retaining elements are arranged in at least two rows which are offset in the transverse direction.

6. The buffer as claimed in claim 1, wherein the profile has at least one longitudinal channel and at least two transverse channels branching off therefrom, and two rows of retaining elements running in the longitudinal direction are arranged on the top cleat surfaces of the rolling surface.

7. The buffer as claimed in claim 1, wherein the buffer consists of a single piece of vulcanized natural or synthetic rubber.

8. The buffer as claimed in claim 1, wherein tip element is a hardened tip.

9. The buffer as claimed in claim 1, wherein the anchoring element consists of plastic, iron, steel, brass, aluminum or other nonferrous metals, and wherein the tip element consists of ceramic material, hardened metal, sintered hard metals or other wear-resistant materials or is coated, using appropriate methods, with a wear-minimizing surface.

10. The buffer as claimed in claim 1, wherein, on its front edge, the buffer has a crosspiece formed by two laterally provided recesses, this crosspiece extending over at least 10% of the overall length of the front edge.

11. The buffer as claimed in claim 1, wherein the rolling surface is of asymmetrical design in that it is drawn upward at the front end and the rear end essentially forms a point, and wherein lateral protrusions, which project laterally beyond the outer contour of the buffer, are provided in addition, at least four such lateral protrusions being provided on each side of the buffer.

12. The buffer as claimed in claim 1, wherein the recess, for accommodating the tip of the pole, has a profiling or a coating on the inner surface, and this makes it easier for the buffer to be removed from the pole, while nevertheless being secured to a sufficient extent for use, the profiling being in the form of channels or grooves running longitudinally in the direction of the pole.

13. A trekking pole, walking stick or Nordic walking pole having a buffer as claimed in claim 1.

14. A method of producing a buffer as claimed in claim 1, wherein the at least two retaining elements are driven into the rolling surface, essentially perpendicularly to the rolling surface, at the appropriate locations, appropriate blind holes having been formed beforehand by drilling or during the process for producing the preform.

15. A method of producing a buffer as claimed in claim 1, wherein the anchoring elements of the at least two retaining elements are pushed into the elastomeric material of the rolling surface, essentially perpendicularly to the rolling surface, at the appropriate locations, in the process being pushed into, and adhesively bonded in, blind holes which are correspondingly formed by drilling or even during the process for producing the preform.

16. The buffer as claimed in claim 1, wherein the element projects beyond the top of the rolling surface by way of a height in the region of 1-2 mm.

17. The buffer as claimed in claim 1, wherein the anchoring element consists of stainless steel, and wherein the tip element consists of hardened steel or sintered hard metals.

18. The buffer as claimed in claim 1, wherein, on its front edge, the buffer has a crosspiece formed by two laterally provided recesses, the crosspiece extending approximately 20-40% over the overall length of the front edge.

19. A buffer for a pole, wherein the buffer, at a top end, has a fastening element for fastening on a pole shaft in the form of a recess, and, at a bottom end, has a rolling surface, and wherein the rolling surface is of essentially planar or only slightly convexly curved design in a transverse direction, as seen in relation to a rolling movement, but in a longitudinal direction, perpendicularly thereto, is curved convexly such that, as a user of the pole is moving, it forms a rolling surface as the pole is pushed off an underlying surface, wherein the rolling surface has a profile with cleats formed by channels, wherein the buffer comprises a hard body element, which is fastened on the pole shaft, and an elastomeric sole element, which, forming the rolling surface, is fastened at the bottom end of the body element, wherein the sole element consists of a single piece of elastomeric material with a hardness of 50-70 Shore A, and wherein at least two elastically mounted, hard, non-elastic retaining elements are arranged in the elastomeric material of the sole element and on at least two top cleat surfaces of the profile wherein the retaining element comprises an anchoring element which is embedded in the elastomeric material of the sole element, wherein, on a side which is directed toward the rolling surface, the anchoring element has a flange which is not embedded in the elastomeric material and surrounds a recess in which a tip element is incorporated and fastened, wherein the tip element projects beyond the rolling surface by 0.5-3 mm, wherein the anchoring element is embedded in the elastomeric material of the sole element with an anchoring depth of 5-10 mm, and wherein the anchoring depth in the elastomeric material of the sole element is larger than the depth of the channels wherein, in the region of the anchoring element which is embedded in the elastomeric material of the sole element, the anchoring element has a plurality of encircling anchoring lamellae, and the encircling anchoring lamellae are of conical design in the direction away from the rolling surface and of stepped design in the direction toward the rolling surface.

20. The buffer as claimed in claim 19, wherein the at least two retaining elements either are fastened on the sole element or, passing through the sole element, are fastened elastically on the body element.

21. A buffer for a pole, wherein the buffer, at a top end, has a fastening element for fastening on a pole shaft in the form of a recess, and, at a bottom end, has a rolling surface, and wherein the rolling surface is of essentially planar or only slightly convexly curved design in a transverse direction, as seen in relation to the rolling movement, but in a longitudinal direction, perpendicularly thereto, is curved convexly such that, as a user of the pole is moving, it forms a rolling surface as the pole is pushed off an underlying surface, wherein the rolling surface has a profile with cleats formed by channels, wherein the buffer consists of a single piece of elastomeric material with a hardness of 50 70 Shore A, and wherein at least two elastically mounted, hard, non-elastic retaining elements are arranged in the elastomeric material and on at least two top cleat surfaces of the profile wherein the retaining element comprises an anchoring element which is embedded in the elastomeric material, wherein, on its side which is directed toward the rolling surface, the anchoring element has a flange which is not embedded in the elastomeric material and surrounds a recess in which a tip element is incorporated and fastened, wherein the tip element projects beyond the rolling surface by 0.5-3 mm, wherein the anchoring element is embedded in the elastomeric material with an anchoring depth of 5-10 mm, and wherein the anchoring depth in the elastomeric material is larger than the depth of the channels.

* * * * *